US005234126A

United States Patent [19]

Jonas et al.

[11] Patent Number: 5,234,126

[45] Date of Patent: Aug. 10, 1993

[54] PLASTIC CONTAINER

[75] Inventors: Henrietta Jonas, Dublin; Ralph A. Gygax, Westerville; William T. Malone, Columbus, all of Ohio

[73] Assignee: Abbott Laboratories, Abbott Park, Ill.

[21] Appl. No.: 817,001

[22] Filed: Jan. 3, 1992

Related U.S. Application Data

[63] Continuation-in-part of Ser. No. 638,281, Jan. 4, 1991, abandoned.

[51] Int. Cl.[5] ..... B65D 23/00; B65D 1/02; B65D 1/09; B65D 1/14

[52] U.S. Cl. ..... 220/609; 215/1 C; 426/111; 426/106; 426/113; 426/127; 426/131; 426/407

[58] Field of Search ..... 426/106, 113, 131, 111, 426/399, 401, 407, 398, 127, 408, 409; 220/609, 608, 607, 623; 215/1 C; 422/26, 25; 53/425, 440

[56] References Cited

U.S. PATENT DOCUMENTS

| | | | |
|---|---|---|---|
| 2,982,440 | 5/1961 | Harrison | 426/111 |
| 3,400,853 | 9/1968 | Jacobsen | 426/111 |
| 3,409,167 | 11/1968 | Blanchard | 220/609 |
| 3,690,507 | 9/1972 | Gailus et al. | 220/608 |
| 3,693,828 | 9/1972 | Kneusel et al. | 220/608 |
| 3,701,455 | 10/1972 | Warnecke | 220/608 |
| 3,905,507 | 9/1975 | Lyu | 220/608 |
| 3,942,673 | 3/1976 | Lyu et al. | 220/608 |
| 4,120,419 | 10/1978 | Saunders | 220/609 |
| 4,125,632 | 11/1978 | Vosti et al. | 426/111 |
| 4,147,271 | 4/1979 | Yamaguchi | 220/609 |
| 4,151,927 | 5/1979 | Cvacho et al. | 220/609 |
| 4,177,746 | 12/1979 | Lee et al. | 220/609 |
| 4,222,494 | 9/1980 | Lee et al. | 220/608 |
| 4,255,457 | 3/1981 | Collias | 426/131 |
| 4,276,987 | 7/1981 | Michel | 215/1 C |
| 4,381,061 | 4/1983 | Cerny | 426/111 |
| 4,412,627 | 11/1983 | Houghton et al. | 220/609 |
| 4,431,112 | 2/1984 | Yamaguchi | 220/609 |
| 4,542,029 | 9/1985 | Caner et al. | 426/131 |
| 4,735,339 | 4/1988 | Benge et al. | 426/407 |
| 4,875,597 | 10/1989 | Saunders | 426/131 |
| 4,880,129 | 11/1989 | McHenry et al. | 426/111 |
| 4,993,567 | 2/1991 | Eberle | 215/1 C |
| 5,005,716 | 4/1991 | Eberle | 215/1 C |

*Primary Examiner*—Steven Weinstein

*Attorney, Agent, or Firm*—Lonnie R. Drayer; Donald O. Nickey

[57] ABSTRACT

There is disclosed a body for a retortable plastic container having a sidewall and bottom wall integrally formed as a single piece. The bottom wall has a heel portion and a recessed center portion. The heel has a resting surface and an inside corner. The recessed center portion has an outside corner. The container has an outside surface. The container is made in accordance with equations relating to reforming pressure and low fill equilibrium pressure and may be fabricated utilizing a variety of manufacturing modes since the providing of acceptable container configurations is not based on relative wall thicknesses.

7 Claims, 4 Drawing Sheets

PLASTIC CONTAINER

This application is a continuation-in-part of application Ser. No. 07/638,281 filed on Jan. 4, 1991, now abandoned.

TECHNICAL FIELD

The present invention relates generally to a semirigid plastic container, and more particularly, to a retortable or autoclavable, plastic container having a unique bottom configuration which, independent of relative wall thickness, obviates paneling and other problems heretofore associated with such containers when they are subjected to terminal sterilization.

BACKGROUND ART

Many products which require sterilization in order to be shelf stable and safe for human consumption, such as food, nutritional, and pharmaceutical products, were originally packaged and terminally sterilized in glass containers. Later, metal cans where used for food and ethical nutritional products in an effort to overcome the problems of glass breakage and excessive distribution and handling weight. Currently, the technology associated with sterilization of products in glass and metal containers is well developed.

Regardless of container style and materials of composition (glass, metal, or polymer), the practice of filling and sealing a product into a container and the process of terminally sterilizing the product after the container is sealed are essentially the same. Most products are filled and sealed into the container so as to substantially reduce headspace air. This minimizes the amount of oxygen in the container which will potentially degrade the nutritional and/or medical potency of the product. In rigid containers this practice generates a vacuum and reduces the pressure exerted by the contents during the sterilization process, especially at peak product temperature. Although vacuums can exist at the sealer in semirigid containers, these may decay with time and many times completely dissipate, especially post sterilization. However, a reduction in headspace air does reduce the pressure exerted by the contents during sterilization, comparable to the case of a rigid container.

Two of the more commonly used methods of reducing headspace air during sealing are a hot fill procedure and steam flushing container headspace during the sealing process. In a hot fill procedure the container is filled with the product and sealed at product temperatures above room temperature, approximately 180° F. When the product is cooled, a vacuum develops due to condensing headspace moisture and contracting headspace gases. In the steam flushing process, steam is used to purge the headspace air out of the filled container, and the container is sealed before the steam condenses. As the steam condenses and headspace gases cool, a vacuum develops. Both methods result in a sealed container with substantially reduced headspace air and, in the case of rigid and the more rigid semirigid containers, a vacuum. Thin walled, low panel strength containers designed for hot fill tend to have bottoms which easily deform inward preventing the net external pressure on the container from exceeding the panel strength of the sidewalls and, thus, preventing the sidewalls from paneling. A container's sidewalls panel when its panel strength is exceeded. The panel strength of a container is defined as the net external pressure at which the side walls of an empty, sealed container buckle inward. Thick walled or high panel strength containers tend to be designed with rigid bottoms since thick-walled container panel strengths tend to be high.

Hot fill alone can be used to sterilize the product if it is a high acid product (approximately below pH 4.6). The container is filled with product and the container is sealed at approximately 180° F. The filled container is then rotated end-over-end so that the hot product contacts all surfaces and, finally, it is held hot for approximately five to ten minutes to kill all viable microorganisms. Microorganisms which are viable at low pH are molds and yeasts. If the product is a low acid product, approximately above pH 4.6, the hot fill process does not produce adequate sterility. Terminal sterilization must be used to kill harmful organisms potentially viable above pH 4.6. Terminal sterilization kills potentially viable organisms by raising product and container temperatures to the equivalent of 250° F. for times equivalent to at least 3 minutes, more often, in excess of 10 minutes as determined using established practices to calculate sterilization process time as a function of product temperature history. The time the product and container are held at an elevated temperature can be reduced markedly by using sterilizer and product temperatures in excess of 250° F. Sterilizer and product temperatures well in excess of 250° F. are commonly used in order to reduce sterilization process time and, thus, product degradation while maintaining microbial kill, since product degradation rates tend to be less temperature sensitive than are microbial death rates. Rigid containers designed for these high-temperature, short-time terminal sterilization processes many times must not only be able to endure the filling and sealing processes using either hot fill or steam flushing, but also must be strong enough to withstand positive net internal pressures, often in excess of 20 psi and negative net internal pressures, or vacuums, often less than −10 psi. These pressures are substantially reduced in semirigid containers capable of deforming without exceeding the failure limits of their materials of construction.

More recently, consumers have indicated an increasing preference for plastic containers, due to factors such as: glass container breakage and metal can damage in distribution; glass container manufacturing and distribution costs; safety with respect to potential glass container breakage; product visibility, especially for monitoring nutritional and pharmaceutical product patient intake; and ecological considerations during container manufacture, product distribution, and either container disposal, recycle, or reuse.

Although consumers have indicated a preference for plastic containers, until fairly recently, container and product manufacturers had to adhere to one or more constraints in order to avoid container distortion during terminal sterilization. Container distortion occurs when the container's materials of construction have been taken beyond their failure limits, and there is objectionable, permanent deformation, post sterilization. These constraints include: (a) The use of low-temperature, long-time processes, with sterilizer temperatures of approximately 250° F. or less and process times greater than approximately 60 minutes to heat, hold, and cool the product in the container, this reduces container-to-container product temperature differences and, thus, decreases container-to-container pressure variation throughout the cycle; (b) the maintenance of precise product fill and headspace gas volumes for more uniform container pressures during sterilization; and (c) the use of container sizes and shapes such as cups and bowls which enhance container panel strength. A cup is a container having a ratio of height to major cross-sectional dimension of less than approximately one. For a drawn or thermoformed, cylindrical container this ratio is the ratio of height to the diameter and is called the draw ratio. The relative shortness of a cup gives it high panel strength as compared to containers with draw ratios above one. A bowl is a cup which does not have a majority of its side wall, between the closure or top and the resting surface or bottom, disposed in a vertical orientation. In the case of a cylindrical bowl, a majority of the side wall is not cylindrical but rather is either conical, some other shape, or, possibly, a combination of various shapes. These irregular sidewall shapes increase the panel strength of these type of containers. Plastic cups and bowls tend to have large closures, usually approximately the same size as the major cross-sectional dimension or diameter. Many times flexible closures are used on these types of containers in order to substantially reduce container vacuum, especially during terminal sterilization, so that container panel strength is not exceeded, thus, avoiding container distortion. However, cups, bowls, and containers with flexible closures are not easily sterilized in high-speed, continuous sterilizers, especially those which are reel-style, or agitating types. This potentially impacts product manufactured cost. Also, cups, bowls, and containers with large, flexible closures are not always the most appropriate container for many food, nutritional, and pharmaceutical products.

Steam retorts operating at saturated steam temperatures and pressures traditionally have been used for metal, glass, and high temperature polymeric materials such as polycarbonate. However air must be added to retorts when food is terminally sterilized in plastic containers in order to prevent excessive container deformation when not using high temperature polymers because materials such as polyolefins tend to have little structural strength at retort temperatures. The pressures required to prevent container distortion are a function of product temperatures, product fill, container headspace and headspace gas volume and commonly are determined experimentally, although emperical and theoretical methods also are available, However, when high-speed, high-temperature, short-time terminal sterilization is applied to products in polyolefin and other plastic containers, the container must be designed to deform reversibly during the process in order to compensate for container-to-container internal pressure variability due to product temperature and fill variabilities, and return to its approximate original shape. In addition, when high speed, continuous sterilizers are used, the product filled container must be able to deform adequately in order to survive a wide range of internal pressures, due to either rising or falling product temperature, while the product passes through large preheating vessels in the initial portion of the sterilizer and cooling vessels after sterilization. The greater the container's capability to deform without distortion, the larger and fewer are the required preheating and cooling vessels, thus reducing the cost and complexity of the continuous sterilizer. Additionally, if the container is compatible with metal can sterilizers with minor modifications for the addition of air to the cook vessels, change over costs are minimal.

Plastic containers are able to deform in order to provide, minimally, adequate volume increase to compensate for differences in thermal expansion by the product and the container material, dependent on filled container headspace and headspace gas volume. It is preferable that a plastic container have in excess of 15% volume increase and 1% or more volume decrease in order to be used with multiple vessel, high speed sterilizers without container distortion, post sterilization. One proposed solution to this need for a plastic container for high-temperature-short-time, hot fill, and other terminal sterilization processes is a polyolefin container configured like a drawn metal can as disclosed in U.S. Pat. No. 4,880,129. That particular patent proffers as the solution to the problem, the presence of localized thin spots in the container's bottom wall to facilitate volumetric expansion of the container due to inward and outward flexing of the bottom wall during sterilization. The patent discloses that it is critical that the sidewall must be thicker than the bottom wall. Furthermore, the container must be either annealed or preshrunk in order to remove residual stresses and avoid excessive volumetric shrinkage when sterilization temperatures are above 190° F. This increases the cost of these types of containers. It is claimed that the container can be manufactured by either thermoforming or injection blow molding. Both conventional and multilayer injection blow molding processes can be used to form the container. U.S. Pat. No. 4,526,821 proffers a potential multilayer injection blow molding process. However, the need to use containers with thick sidewalls in order to maintain container panel strength, due to excess sidewall thickness variability within individual containers, in combination with the cost of annealing or preshrinking the containers dramatically increases container cost and significantly reduces the financial attactiveness of this prior art container.

It thus apparent that a need exists for an improved plastic container capable of being use din conventional terminal sterilization equipment. It is also apparent that the need exists for an improved plastic container able to survive retort conditions.

DETAILED DESCRIPTION OF INVENTION

The present invention is a retortable, semirigid plastic container having a unique bottom wall configuration which, independent of relative wall thicknesses obviates paneling and other problems heretofore associated with such containers when they are subjected to terminal sterilization. It is critical that during the filling, sealing, and terminal sterilization processes the bottoms of these containers can be configured so that they are capable of deflecting both inward and outward in order to provide adequate volumetric contraction and expansion of filled, sealed containers in order to compensate for container-to-container pressure variability due to various causes as described previously herein and sterilizer pressures, as constrained by the type of sterilizer, as described previously herein, being used without paneling the sidewalls of the container.

During terminal sterilization polyolefin and other plastic materials become markedly flexible and the bottom walls readily deflect so as to reduce pressure differentials across the container wall. The preferred practice is to keep as much of the bottom wall as flat as possible so that pressures required to deflect the bottom wall do not exceed the curved sidewall panel strength. As more curved or irregular shaped surfaces are added to the bottom wall, the bottom wall becomes more rigid and the likelihood of exceeding sidewall panel strength increases. For this reason the three bottom wall radii design proffered in U.S. Pat. No. 4,880,129 is undesirable even when the bottom wall is thinner than the sidewall.

The preferred manufacturing technology for the current invention is either a plug assist or a cuspation dialation plug assist, near melt-phase, thermoforming process with forming pressures in excess of one hundred psi. The thermoformer runs in-line with a coextrusion sheet extruder so that the material is very near its melt temperature, especially in its core, during thermoforming and there is no need to anneal or preshrink containers. Sidewall thickness control is superior to the previously mentioned manufacturing processes, so that containers with thinner sidewalls are being successfully manufactured.

There are two critical criteria of the bottom wall of a container in order to avoid paneled sidewalls. First, the bottom wall must be able to deflect outward to almost a hemispherical shape and then, most importantly, return to its original configuration without causing paneled sidewalls during product terminal sterilization. Second, comparable to that required of hot filled product containers, the bottom must deflect inward adequately to avoid sidewall paneling, post sterilization and during distribution and use. However, since the bottom must perform both functions, sharp radii which many times are used in hot fill containers, must be avoided because they become stress concentrators causing localized material failures and, thus, container distortion during terminal sterilization.

The first performance criterium is required, after the product has reached the required time at temperature to accomplish product sterilization. Immediately, as the cooling phase of the sterilization cycle begins, bottom wall outward deflection will start to decrease. At this time one or more areas of the bottom wall which are normally concaved inward may be convexed outward, dependent on product fill and headspace gas volume. As cooling continues the net external pressure will build to the point where the bottom surfaces of the container snap-through from convexed outward to concaved inward shapes. If this snap-through pressure is above the panels strength of the side wall, the bottom may not snap through, potentially resulting in a rocker bottomed container.

The second performance criteria is required after the container is exposed to atmospheric pressure and cools to ambient temperature. The bottom wall of the container must deflect inwardly to compensate for the reduction in headspace gas pressure and differences in the thermal expansion of the product and the container wall materials. The bottom wall must do this in spite of having deflected outward to a hemispherical configuration which may potentially result in permenant, localized deformation which must be overcome without causing sidewall paneling. The internal container pressure at which the container bottom wall deflects to its inward limit, without producing side wall paneling, under the conditions simulated, is the minimum distribution equilibrium pressure index.

The internal container pressure at which the bottom wall snaps through without side wall paneling is the snap-through pressure index. A container with a rocker bottom is one which either leans to one side or initially rocks back and forth when placed on a flat surface. Dependent on the severity of the bottom wall distortion and the snap-through pressure, the container also may or may not be paneled, and paneled containers may or may not be rocker bottomed. The two types of defects which a container may exhibit when this first is not met are paneled sidewalls or a combination of a rocker bottom and paneled side wall. When the second is not met, the resulting defect is paneled side walls.

Because it is difficult, if not impossible, to assign a cause to each container failure during sterilization, it is necessary to use nonlinear, high deflection, finite element analysis in conjunction with complex, temperature dependent, material models to simulate container deformation during sterilization. It is only in this way that the logistics of experimentally exploring all possible container bottom wall profiles for a range of container sizes are overcome. In order to make the present invention over 100 finite element analyses were run and a second order polynomial approximation was fit to the responses. In excess of one million possible designs were evaluated using the polynomial approximation. Approximately two and one-half percent of the bottom wall profiles evaluated performed acceptably using the polynomial. A number of the designs predicted to be acceptable by the polynomial model and confirmed using finite element analyses were tested, and designs which performed best as predicted performed best in terminal sterilization tests. Unfortunately, as the performance indices got closer to the performance criteria it became more difficult to experimentally discriminate between designs with the small number of prototypes tested. Only polynomial results are presented. A biased polynomial approximation for the snap-through pressure is used herein and in the claims in order to more precisely delineate between acceptably and unacceptably performing containers at the performance limit claimed. Although the response of the polynomial approximations are expressed in units of p.s.i., these are only performance indices, indicating the most optimum bottom profile designs, and actual panel strengths will be dependent upon the small deflection elastic properties of the specific material of construction. However, for a given material, these preferred bottom profile designs will be the same, due the geometric surface shape relationship between a thin, round side wall and a thin, flat bottom of a given container. Wall thicknesses are less than 5% of either the major cross-sectional dimension or, in the case of a cylindrical container, 5% of the cross-sectional diameter.

BRIEF DESCRIPTION OF THE DRAWINGS

FIG. 6 is a partial vertical sectional view of the preferred embodiment of a plastic container made in accordance with the present invention.

DETAILED DESCRIPTION OF THE DRAWINGS

Figure 1:
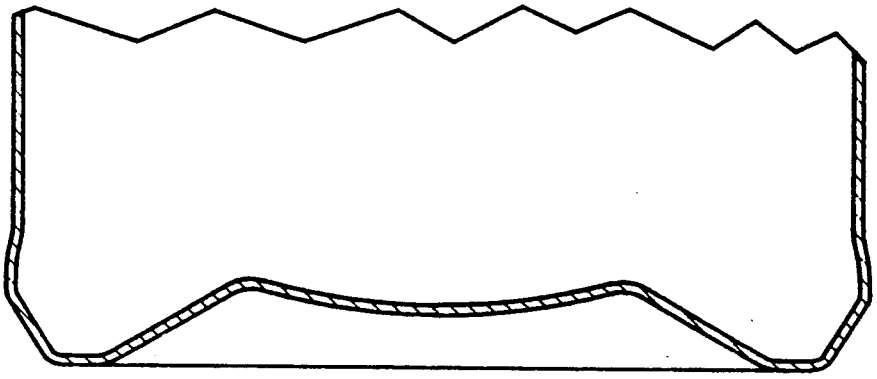
FIG. 1 is a partial vertical sectional view of a first plastic container.
Figure 2:
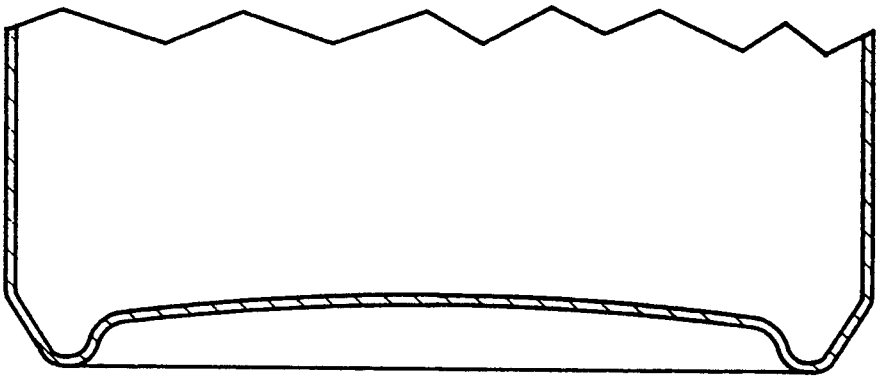
FIG. 2 is a partial vertical sectional view of a second plastic container.
Figure 3:
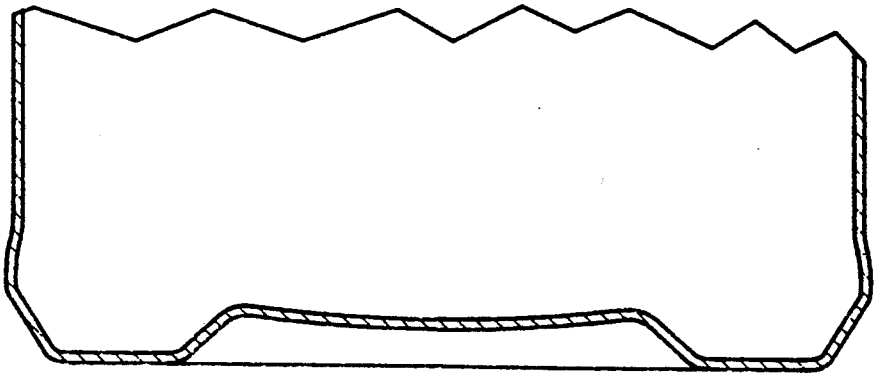
FIG. 3 is a partial vertical sectional view of a third plastic container, formed in accordance with the present invention.

Having reference to the drawings, attention is directed first to FIGS. 1, 2 and 3 which illustrate vertical cross sectional views of three plastic containers. The partial vertical sectional views of the plastic containers as shown in FIGS. 1, 2 and 3 do not, based solely upon their appearance, provide any indication based on the prior art as to whether a container made in accordance with any one of the configurations shown in FIGS. 1–3 would adequately perform when such container is subjected to terminal sterilization. The type of containers shown are known as low panel strength containers. In such containers, the container itself is not altered through the addition of strengthening items such as ribs.

Figure 4:
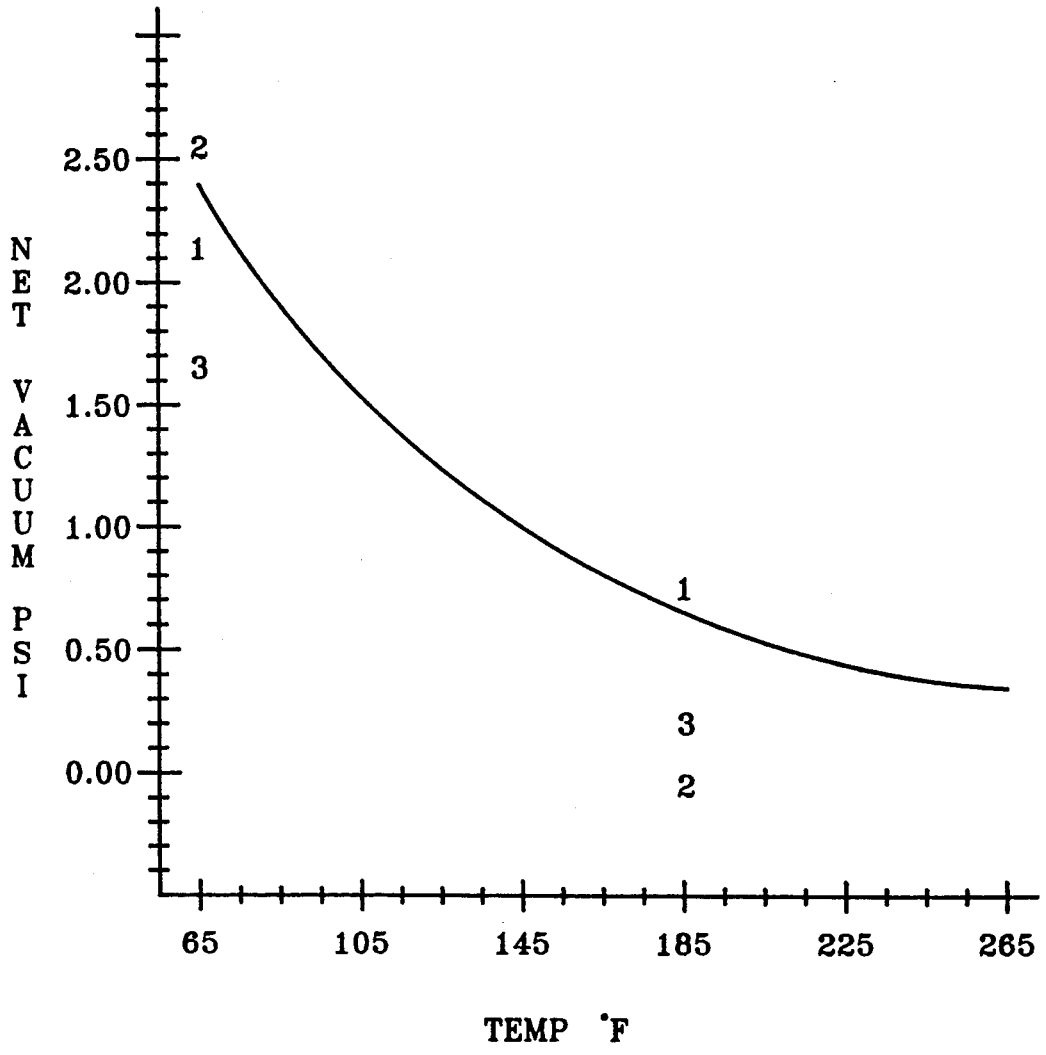
FIG. 4 is a graph comparing net vacuum versus container wall temperature, which graph discloses acceptable container configurations.

FIG. 4 graphically depicts a comparison of net vacuum in pounds per square inch versus container wall temperature when plastic containers made in accordance with FIGS. 1–3 are subjected to terminal sterilization. The sloping line is indicative of the maximum values, above which line the container's side walls panel to maintain integrity either during and/or following sterilization. For example, the container bottom associated with FIG. 1 does not perform acceptably when the container is heated to relatively high temperatures, although the container performance at lower temperatures is acceptable. Similarly, the container configuration shown in FIG. 2 performs acceptably during the high temperature sterilization process, but fails to perform acceptably when the container is subjected to lower temperatures associated with the cooling process. Finally, the container configuration associated with FIG. 3 can be seen as being fully able to perform during heating, cooling and post sterilization.

The container shown in FIG. 3 is able to successfully meet the two critical performance criteria associated with retortable plastic containers, notwithstanding the fact that bottom wall thicknesses are not less than sidewall thicknesses. Thus, the container configuration shown in FIG. 3 permits the formation of a retortable, plastic container not dependent on bottom wall thicknesses being less than side wall thicknesses.

Heretofore, in low panel strength containers, the problems associated with paneling and reforming have been tolerated along with the accompanying adverse economic impact, since container design depended essentially on the success of trial and error technique. It has been desirable to ascertain a geometric container configuration or configurations, which would not suffer from the problems associated with prior art plastic containers, particularly those made with relatively uniform wall thickness, such as by thermoforming.

It has been discovered that by manufacturing a container with a bottom wall having a minimum distribution equilibrium pressure of greater than the panel strength of the container and a snap-through pressure inside the container always less than the panel strength of the container sidewall that the plastic container can survive retort conditions. It has further been discovered that there are a plurality of fairly critical numerical values associated with certain parameters of the container which enable the generation of container bottoms which will survive terminal sterilization. The advantages associated with the ability to ascertain whether a particular proposed container configuration will produce acceptable results can best be appreciated by the fact that there are literally millions of theoretical container bottom configurations. The cost associated with testing any given proposed configuration by computer simulation as compared to actual making of a mold, is relatively inexpensive.

Figure 5:
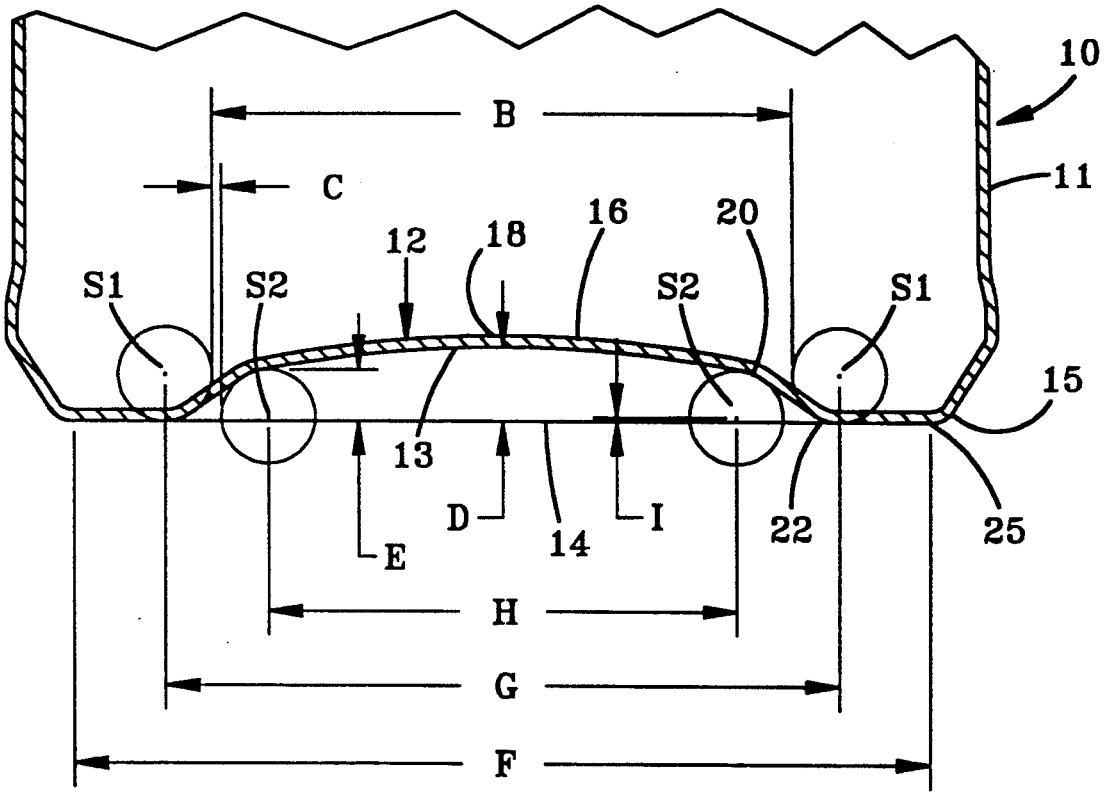
FIG. 5 is a partial vertical sectional view of a plastic container made in accordance with the present invention.
Figure 5:
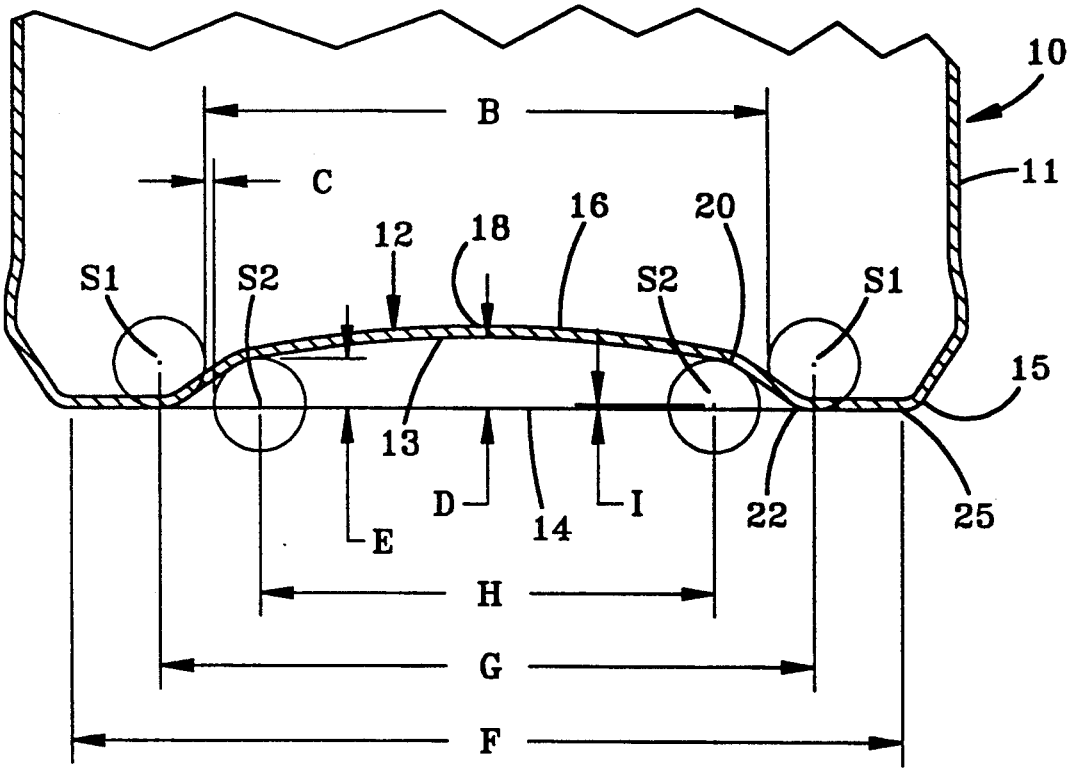

An example of a base portion of a retortable low panel strength plastic container 10 according to the invention is shown in FIG. 5, which is a fragmentary cross-sectional view taken in a vertical plane which contains the longitudinal axis 18 of the container.

As used herein and in the claims "container" is understood to mean a container by itself without a closure.

As used herein and in the claims "panelling" is understood to mean a localized deformation in the sidewall of a container. As used herein and in the claims "panel strength" is understood to means the net external pressure (difference between external and internal pressure) at which the sidewall of an empty sealed container buckles at a temperature of 70° F. As used herein and in the claims "low panel strength" is understood to mean a panel strength index of less than about 2.5 p.s.i.

The term "headspace" may be defined as the volume of gas (in a container) between the upper surface of the product and the lower surface of the container's top. For example, in a container packed without the use of a vacuum, the volume of product and the volume of headspace gas equal the volume of the container. In a container packed under a vacuum, the volume of product plus the volume of headspace gas is less than the volume capacity of the container when sealed. The internal container volume or total fill equals the headspace volume plus the product volume. As used herein and in the claims "plastic" is understood to have the meaning stated in ASTM D883-5T, to wit: a material that contains as an essential ingredient an organic substance of large molecular weight, is solid in its finished state, and, at some stage in its manufacture, or in its processing into finished articles can be shaped by flow.

As used herein and in the claims terms such as "upper", "lower", "top", "bottom" and other words describing relative vertical locations are understood to refer to a container that is sitting on a flat and level surface such that the longitudinal axis of the container is oriented perpendicular to the flat surface.

As used herein and in the claims "vertical" is understood to mean a direction which is both parallel to the longitudinal axis of a container and perpendicular to a flat and level surface upon which the container is resting, and "horizontal" is understood to mean a direction which is both perpendicular to the longitudinal axis of a container and parallel to a flat and level surface upon which a container is resting.

As used herein and in the claims "radial" and "radially" are understood to mean directions which are perpendicular to the longitudinal axis of the container, with "radially inward or inwardly" being a direction going towards the longitudinal axis and "radially outward or outwardly" being a direction going away from the longitudinal axis.

The base portion of the container 10 includes a sidewall 11 and a bottom wall 12 which are formed as a single piece. The container has an exterior surface 13 and an interior surface. At the lowermost portion of the exterior surface of the bottom wall of the container is a resting surface 14, at a heel portion 15 of the base portion of the container 10, which extends circumferentially about a recessed circular center portion 16 of the bottom of the container which has as its center the longitudinal axis 18 of the container. Associated with the curvature of the exterior surface 13 of the bottom of the container at both an inside corner 22 which connects the resting surface with the recessed center portion and an outside corner 20 which is disposed within the recessed center portion 16 are two swing points S1 and S2 which appear in this cross-sectional view of the container as the center points of circles which are hereinafter referred to by their center points. As used herein and in the claims a corner is an "outside corner" if the swing point associated therewith is located exterior of the container and is an "inside corner" if the swing point associated therewith is located interior of the container. Of course, circles S1 and S2 are actually circular cross sections of toroids (donut shaped structures).

A (not shown in the drawing) is the weighted average of the radii of the two circles S1 and S2, wherein the weighted average of the radii is the quotient of (a) the angular value of an arc of circle S1 which is in contact with the exterior surface of the bottom wall of the container times the radius of circle S1, plus the angular value of an arc of circle S2 which is in contact with the exterior surface of the bottom wall of the container times the radius of circle S2, divided by (b) the sum of the angular values of the two arcs. As will be apparent from the embodiments illustrated in FIGS. 5 and 6 circles S1 and S2 may or may not have equal radii. As used herein and in the claims the "angular value of an arc" is the value of the included angle having a vertex at the center of a circle and defined by radii of the circle which extend to the end points of the arc. Put another way, in a cross-sectional profile of the exterior surface 13 of the recessed circular center portion 16 of the bottom wall of a container taken in a vertical plane which contains the longitudinal axis 18 of the container, A is the weighted average of the radii of (a) a first circle S1 which is a cross-section of a first toroid which is associated with the curvature of the exterior surface of the bottom of the container at an inside corner 22 which connects the resting surface with the recessed circular center portion and (b) the radius of a second circle S2 which is a cross-section of a second toroid which is associated with the curvature of the exterior surface of an outside corner 20 which is disposed within the recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs.

The determination of the value of A may be illustrated by referring to FIG. 6, wherein a preferred container, which will be described below more fully, has a circle S1 with a radius of 0.127 inch and an angular value of the contacting arc being 72°, with the radius of circle S2 being 0.127 inch and an angular value of the contacting arc being 78°.

$$A = \frac{72 * 0.127 + 78 * 0.127}{33 + 36}$$

$$A = 0.127 \text{ inch}$$

B is the minimum horizontal distance measured along a line which intersects the longitudinal axis 18 of the container between a circle S1 on one side of the longitudinal axis and another circle S1 on the other side of the longitudinal axis. Put another way, in a cross-sectional profile of the exterior surface 13 of the recessed circular center portion 16 of the bottom wall of a container taken in a vertical plane which contains the longitudinal axis 18 of the container, B is the minimum horizontal distance between two circles S1, S1 which are disposed on opposite sides of the longitudinal axis 18 of the container with both of these circles being cross-sections of a toroid which is associated with the curvature of the exterior surface of the bottom of the container at an inside corner 22 which connects the resting surface 14 with the recessed circular center portion 16.

C is the horizontal distance measured along a line which intersects the longitudinal axis 18 of the container between a first vertical line which is tangent to a first circle S1 and a second vertical line which is tangent to a second circle S2, both of said vertical lines being located on the same side of the longitudinal axis and both of said vertical lines being interposed between circles S1 and S2. Put another way, in a cross-sectional profile of the exterior surface 13 of the recessed circular center portion 16 of the bottom wall of a container taken in a vertical plane which contains the longitudinal axis 18 of the container, C is the horizontal distance between (a) a first vertical line which is tangent to a first circle S1 which is a cross section of a first toroid which is associated with the curvature of the exterior surface of the bottom of the container at an inside corner 22 which connects the resting surface with the recessed circular center portion and (b) a second vertical line which is tangent to a second circle S2 which is a cross-section of a second toroid which is associated with the curvature of the exterior surface of an outside corner 20 which is disposed within the recessed circular center portion.

D is the vertical distance between (a) a horizontal line which is tangent to the resting surface 14 of the container (b) and the exterior surface 13 of the bottom wall of the container as measured along the longitudinal axis 18 of said container. Put another way, in a cross-sectional profile of the exterior surface 13 of the recessed circular center portion 16 of the bottom wall of a container taken in a vertical plane which contains the longitudinal axis 18 of the container, D is the vertical distance between (a) a horizontal line which is tangent to the resting surface 14 of the container and (b) the exterior surface 13 of the bottom of the container as measured along the longitudinal axis 18 of said container.

E is the vertical distance between (a) the resting surface 14 of the container and (b) a horizontal line which is tangent to the top of a circle S2 associated with the curvature of the exterior surface of the bottom wall of the container at the outside corner 20 which is disposed within the recessed circular center portion. Put another way, in a cross-sectional profile of the exterior surface 13 of the recessed circular center portion 16 of the bottom wall of a container taken in a vertical plane which contains the longitudinal axis 18 of the container, E is the vertical distance between (a) a horizontal line which is tangent to said resting surface and (b) a horizontal line which is tangent to the top of a circle which is a cross-section of a toroid which is associated with the curvature of the exterior surface of an outside corner 20 which is disposed within the recessed circular center portion.

F is the horizontal distance between the radially outer edge of the resting surface 14 on opposite sides of the longitudinal axis 18 of the container as measured on a line which intersects the longitudinal axis. Put another way, in a cross-sectional profile of the exterior surface 13 of the recessed circular center portion 16 of the bottom wall of a container taken in a vertical plane which contains the longitudinal axis 18 of the container, F is the horizontal distance between (a) the radially outer edge of the recessed circular center portion 16 of the bottom wall of the container on one side of the longitudinal axis 18 and (b) the radially outer edge of the recessed circular center portion of the bottom wall of the container on the opposite side of the longitudinal axis.

G is the horizontal distance measured along a line which intersects the longitudinal axis 18 between the centerpoints of circle S1 on one side of the longitudinal axis and circle S1 on the other side of the longitudinal axis. Put another way, in a cross-sectional profile of the exterior surface 13 of the recessed circular center portion of the bottom wall of a container taken in a vertical plane which contains the longitudinal axis 18 of the container, G is the horizontal distance between (a) the center point of a first circle S1 on one side of the longitudinal axis and (b) the center point of a second circle S1 on the opposite side of the longitudinal axis, with both of the circles being cross-sections of a toroid which is associated with the curvature of the exterior surface of the bottom of the container at an inside corner 22 which connects the resting surface with the recessed circular center portion.

H is the horizontal distance measured along a line which intersects the longitudinal axis 18 between the centerpoints of a circle S2 on one side of the longitudinal axis and a circle S2 on the other side of the longitudinal axis. Put another way, in a cross-sectional profile of the exterior surface 13 of the recessed circular center portion of the bottom wall of a container taken in a vertical plane which contains the longitudinal axis 18 of the container, H is the horizontal distance between (a) the center point of a first circle S2 on one side of the longitudinal axis and (b) the center point of a second circle S2 on the opposite side of the longitudinal axis, with both of the circles being cross-sections of a toroid which is associated with the curvature of the exterior surface of an outside corner 20 which is disposed within the recessed circular center portion.

I is the vertical distance from the resting surface 14 of the container bottom to the centerpoint of a circle S2 associated with the curvature of the outer surface of the inside corner of the heel. Put another way, in a cross-sectional profile of the recessed circular center portion of the bottom wall of a container taken in a vertical plane which contains the longitudinal axis 18 of the container, I is the vertical distance between (a) a line which is tangent to the resting surface 14 of the container and (b) the center point of a circle S2 which is a cross-section of a toroid which is associated with the curvature of the exterior surface of an outside corner 20 which is disposed within the recessed circular center portion.

The significance of the "normalizing factor" N is that 2.322 is the value of the dimension F in the container of the preferred embodiment illustrated in FIGS. 3, 5, and 6. This base size for a container was successfully developed, and other container according to the invention are scaled up or down from this base container by normalizing the dimensions. The normalized values for the ranges set forth in the preceding paragraph are as follows: NA is in the range of 0.0775 inch to 0.1435 inch; NB is in the range of 1.2050 inch to 2.1025 inches; NC is in the range of −0.0433 inch to 0.25 inch; ND is in the range of 0.0870 inch to 0.288 inch; and NE is in the range of 0.1200 inch to 0.2746 inch; and N is between 0.7369 and 1.7227 for F between 1.711" and 4.000."Normalized values are calculated as follows: NA=A÷N; NB=B÷N; NC=C÷N; ND=D÷N; and NE=E÷N.

Examples of several other base portions for retortable low panel strength plastic containers according to the invention are illustrated in FIGS. 3 and 6. The reference characters and dimensions of the embodiments illustrated in FIG. 6 correspond with those already described with respect to FIG. 5.

FIG. 5 discloses an embodiment of the invention wherein: A=0.1270"; B=1.5760"; C=0.0250"; D=0.2000", E=0.1390"; F=2.3220"; N=1.000, with the minimum distribution equilibrium pressure index being equal to −1.8 p.s.i. and the reforming pressure being equal to 0.0 p.s.i.

It has also been found that for the container made in accordance with this invention, the minimum distribution equilibrium pressure index is equal to:

$$D=o+b*NB+n*N+bn*NB*N+b2*NB*NB+n2*N*N$$

In the above equation:

o=−5.648776;
b=−0.108990;
n=5.908261;
bn=1.392024;
b2=−0.682909;
n2=−2.417964

Similarly, it has been determined that the snap-through pressure index is equal to:

$$S = o + a*NA + b*NB + c*NC + d*ND + e*NE + n*N + ad*NA*ND + an*NA*N + bc*NB*NC + bd*NB*ND + bn*NB*N + dn*ND*N + en*NE*N + a2*NA*NA + b2*NB*NB + e2*NE*NE$$

In the above equation:

o=1.490349;
a=−43.955514;
b=−2.719758;
c=11.475094;
d=−167.661253;
e=23.846363;
n=2.479035;
ad=121.517421;
an =−15.800215;
bc=−7.375851;
bd=7.573549;
b=−1.012955;
dn=−5.092623;
en=9.968270;
a2=201.102995;
b2=1.067584;
e2=−113.610115.

For said minimum distribution equilibrium pressure index and said snap-through pressure index the ranges of NA–NE and N have been found to be as follows: NA is between 0.0775" and 0.1435"; NB is between 1.2050"

and 2.0000"; NC is between −0.0125" and 0.2385", ND is between 0.0870" and 0.2610"; NE is between 0.1200" and 0.2400"; and N is between 0.73679 and 1.7227 for F between 1.7110" and 4.0000". While the ranges of NA, NB, NC, ND, NE, F, and N actually result in a low fill equilibrium pressure index range of between −3.5 and −0.8 p.s.i. and a snap-through pressure index range of between −1.6 to 0.7 p.s.i., preferably the minimum distribution equilibrium pressure is greater than −2.4 p.s.i. and the snap-through pressure index is greater than −0.5 p.s.i.

The ability to utilize the equation associated with this invention permits the prediction of acceptable container design to be made with certainty.

Preferably the plastic container permits a food product to be packaged in such container having a headspace between the container top and the food product between 1 and 4 percent of the volume of the container. Under the low fill pressure conditions, the fill is approximately 93%, while under high fill conditions, the fill is approximately 97%. In the preferred embodiment, the low temperature panel strength of the container is approximately 2.5 p.s.i., and the panel strength at snap-through is approximately 0.7 p.s.i.

Due to the unique geometric configuration associated with the plastic container of this invention, the criticality of wall dimensions and material properties are rendered essentially irrelevant.

BEST MODE

In actual utilization, a retortable plastic container made in accordance with this invention is fabricated utilizing the equation, constants, and parameters discussed above so as to create a retortable, semi-rigid plastic container, which upon being subjected to retort conditions exhibits reforming, but not buckling. For example, FIG. 5 discloses an acceptable plastic container bottom made in accordance with this invention. In this particular embodiment, NA=0.1270"; NB=1.5760"; NC=0.0250"; ND=0.2000"; NE=0.1390"; F=2.3220"; and N=1.0000 with the minimum distribution equilibrium pressure index being equal to −1.8 p.s.i. and the reforming pressure being equal to 0.0 p.s.i. As can be seen, in this embodiment the container bottom is curved slightly concave inward.

FIG. 6 discloses what is believed to be a preferred embodiment of the invention. In this embodiment, NA=0.0775"; NB=2.0000"; NC=0.0277"; ND=0.0870"; NE=0.1200"; F=2.3220", and N=1.0000 with the minimum distribution equalibrium pressure index being equal to −2.3 p.s.i. and the snap-through pressure index being equal to 0.0 p.s.i. In this preferred embodiment the container bottom is curved slightly concave outward. In other potential, acceptable embodiments the recessed center portion is relatively flat.

The container of this invention is characterized by flexibility with all blends of food grade polyolefin material, including mono- and/or multi-layer barrier materials. Preferably the material is an impact copolymer. Preferably the outside layer of the container is fabricated from a polyolefin material with a gas barrier being interposed between the outside layer and the inside layer, which is preferably formed of an ethylene vinyl alcohol copolymer, or more preferably polypropylene. The container of the preferred embodiment of this invention may have the polyolefin outer layer formed from either an ethylene/propylene copolymer or a polypropylene/polyethylene blend. Additionally, the container made in accordance with this invention may be formed using one of several modes of manufacture, namely extrusion blow molding, injection blow molding, injection molding, or thermoforming.

INDUSTRIAL APPLICABILITY

Annually, more than 200,000,000 units of pediatric nutritional products alone are distributed in the U.S. The majority of these products currently utilize glass or metal containers. The industry has long sought ways to eliminate glass and metal containers and move to a less expensive container such as one formed from plastic, however the container must be retortable. This invention solves this long sought need. The container is not limited to usage in the pediatric nutritional area, and could be utilized in such areas as adult nutritional foods, or pharmaceutical products.

The product container formed by this invention can be utilized in existing sterilization equipment. One advantage of this is that in the continuous agitation sterilizers currently utilized, the product can be heated and cooled faster due to the rotation of the can during the sterilization process. This possesses the advantage of there being less damage to the product, especially where the product is heat sensitive such as is the case with milk or soy based products, and consequently it is important to minimize exposure to heat. In the above nutritional products, overexposure to heat can result in poorer color as well as decreased nutrition as the result of protein degradation.

The performance of the container of this invention is being able to deform at least 6% and preferably in excess of 15% without producing catastrophic failure permits the container to function in batch sterilization which typically exposes the containers within a batch to a diverse range of temperature and pressure conditions, especially during the cooling portion of the cycle.

As opposed to the container of U.S. Pat. No. 4,880,129, which requires the bottom wall thicknesses to be less than the side wall thicknesses. While overpressure may be utilized in the manufacture of containers in accordance with this invention, it is applied to prevent localized catastrophic failure, as opposed to being utilized solely to facilitate bottom wall snap-through and container reforming.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A retortable, plastic container capable of surviving retort at over 250° without catastrophic failure which is adapted, when closed, to hold a product under vacuum, comprising a sidewall and a bottom wall integrally formed as a single piece, said container having an outer surface, said bottom wall having a heel portion surrounding a recessed center portion, said heel portion having a circular resting surface which is connected to said recessed center portion by an inside corner which extends along a radially inner edge of said resting surface, said recessed center portion having only a single circumferentially extending outside corner disposed therein, said bottom wall having a minimum distribution equilibrium pressure index which is the internal container pressure at which the bottom wall deflects to its inward limit without producing side wall panelling of −2.4 p.s.i. to −0.8 p.s.i. and a snap-through pressure index −0.5 p.s.i. to 0.7 p.s.i. which is the internal container pressure at which the bottom wall snaps through from convex to concave without side wall panelling, said minimum distribution equilibrium pressure index being equal to:

o+b*NB+n*N+bn*NB*N+b2*NB*NB+n2*N*N where o=−5.648776;
b=−0.108990;
n=5.908261;
bn=1.392024;
b2=0.682909;
n2=−2.417964;

and snap-through pressure index equal to:

$$o + a*NA + b*NB + c*NC + d*ND + e*NE + n*N + ad*NA*ND + an*NA*N + bc*NB*NC + bd*NB*ND + bn*NB*N + dn*ND*N + en*NE*N + a2*NA*NA + b2*NB*NB + e2*NE*NE$$

where:

o=1.490349;
a=43.955514;
b=−2.719758;
c=11.475094;
d=−16.661253;
e=23.846363;
n=2.479035;
ad=121.517421;
an=−15.800215;
bc=−7.375851;
bd=7.573549;
bn=−1.012955;
dn=−5.092623;
en=9.968270;
a2=201.102995;
b2=1.067584;
e2=−113.610115;

where for said minimum distribution equilibrium pressure index and said snap-through pressure index NA is between 0.0775" and 0.1435"; NB is between 1.2050" and 2.0000"; NC is between −0.0125" and 0.2385"; ND is between 0.0870" and 0.2610"; NE is between 0.1200" and 0.2400", and F is between 1.7110" and 4.0000"; and N is between 0.7369 and 1.7227; NA is A÷N; NB is B÷N, NC is C÷N; ND is D÷N; and NE is E÷N; with A being in the range of 0.0571 inch to 0.2472 inches and being the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs;

B being in the range of 0.8879 inch to 3.6219 inches and being the minimum horizontal distance between two circles which are disposed on opposite sides of the longitudinal axis of the container and are both cross sections of said first toroid;

C being in the range of −0.0319 to 0.4307 inch and being the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D being in the range of 0.0641 inch to 0.496 and being the vertical distance between (a) a horizontal line which is tangent to said resting surface and (b) the exterior surface of the bottom of said container at the longitudinal axis of said container;

E being in the range of 0.0884 inch to 0.4730 inches and being the vertical distance between (a) a horizontal line which is tangent to said resting surface and (b) a horizontal line which is tangent to the top of a circle which is a cross-section of said second toroid; and, F being in the range of 1.711 inch to 4.000 inches and being the horizontal distance between (a) the radially outer edge of the recessed circular center portion on one side of the longitudinal axis and (b) the radially outer edge of the recessed circular portion on the opposite side of the longitudinal axis; and N being the ratio of F to 2.322.

2. The container according to claim 1 wherein said container is a low panel strength container.

3. The container according to claim 1 wherein said

4. The container according to claim 1 wherein said recessed center portion is convex relative to said heel portion.

5. The container according to claim 1 wherein said recessed center portion is concave relative to said heel portion.

6. The container according to claim 1 wherein said container is co-extruded, said sidewall and bottom wall formed in layers, and said layers of the container have a gas barrier therebetween.

7. The container according to claim 1 wherein said container is thermoformed.

* * * * *

UNITED STATES PATENT AND TRADEMARK OFFICE
CERTIFICATE OF CORRECTION

PATENT NO. : 5,234,126

DATED : August 10, 1993

INVENTOR(S) : H. Jonas, R. Gygax, W. Malone

It is certified that error appears in the above-identified patent and that said Letters Patent is hereby corrected as shown below:

Column 5, Line 46, "panels" should be --panel--

Column 11, Line 67, "container" should be --containers--

Column 12, Line 52, "d=-167.661253;" should be --d=-16.661253--

Column 12, Line 59, "b=-1.012955;" should be --bn=-1.012955;--

Claim 3 should be corrected to read as follows: The container according to claim 1 wherein said recessed center portion is relatively flat.

Signed and Sealed this

First Day of November, 1994

Bruce Lehman

*Attest:*

BRUCE LEHMAN

*Attesting Officer*

*Commissioner of Patents and Trademarks*